United States Patent [19]

Mizunuma et al.

[11] Patent Number: 4,847,579

[45] Date of Patent: Jul. 11, 1989

[54] FERROMAGNETIC RESONATOR

[75] Inventors: Yasuyuki Mizunuma, Kanagawa; Hiroyuki Nakano, Tokyo; Yoshikazu Murakami, Kanagawa, all of Japan

[73] Assignee: Sony Corporation, Tokyo, Japan

[21] Appl. No.: 109,741

[22] Filed: Oct. 19, 1987

[30] Foreign Application Priority Data

Oct. 20, 1986 [JP] Japan ..... 61-2449246

[51] Int. Cl.[4] ..... H01P 7/00

[52] U.S. Cl. ..... 333/219.2; 333/204

[58] Field of Search ..... 333/219, 204, 202, 219.2

[56] References Cited

U.S. PATENT DOCUMENTS

| | | | |
|---|---|---|---|
| 3,521,195 | 7/1970 | Bosma | 333/1.1 |
| 3,544,920 | 12/1970 | Konishi | 333/1.1 |
| 4,152,676 | 5/1979 | Morgenthaler | 333/202 X |
| 4,247,837 | 1/1981 | Mezak et al. | 333/202 |
| 4,543,543 | 9/1985 | Blight et al. | 333/219 X |
| 4,547,754 | 10/1985 | Murakami et al. | 333/204 X |
| 4,636,756 | 1/1987 | Ito et al. | 333/202 |
| 4,679,015 | 7/1987 | Murakami et al. | 333/204 X |
| 4,701,729 | 10/1987 | Ito et al. | 333/234 X |

FOREIGN PATENT DOCUMENTS

| | | |
|---|---|---|
| 164685 | 12/1985 | European Pat. Off. . |
| 2131628 | 6/1984 | United Kingdom . |

OTHER PUBLICATIONS

Adam, I. D. et al.; "Studies of FMR Linewidth in Thick YIG Films Grown by Liquid Phase Epitaxy"; *AIP Conference Proc.*, No. 18, Part 2; 1973, pp. 1279–1283.

Simpson, J. T.; "Turnable Microwave filters Using YIG Grown by Liquid Phase Epitaxy" 4th *European Microwave Conf.*, Montreux, Switzerland; Sep. 10–13, 1974; pp. 590–594.

IEEE Transactions on Microwave Theory and Techniques, May 1965, pp. 306–315.

*Primary Examiner*—Eugene R. LaRoche

*Assistant Examiner*—Benny Lee

*Attorney, Agent, or Firm*—Hill, Van Santen, Steadman & Simpson

[57] ABSTRACT

A ferromagnetic resonator is disclosed, in which perpendicular ferrimagnetic resonance of thin film YIG is utilized. The resonator comprises a ferrimagnetic YIG thin film and a microstrip line coupled to the YIG thin film operative in a bias magnetic field applied perpendicular to a major surface of the YIG thin film. The YIG thin film disk has a magnetization distribution of magnetostatic mode, and the microstrip line is designed to generate a high-frequency magnetic field distribution similar to the magnetization distribution of the uniform mode $(1, 1)_1$. In such arrangement, coupling between the high-frequency magnetic field and magnetization of high sprious mode is reduced.

12 Claims, 21 Drawing Sheets f=10GHz
Δf=0.6GHz
a/b=7/3 f=10GHz
Δf=0.6GHz
a/b=6/4 f = 5 GHz
Δf = 0.4 GHz
50 Ω Transmission Line

FERROMAGNETIC RESONATOR

BACKGROUND OF THE INVENTION

The present invention relates to a ferromagnetic resonator utilizing ferromagnetic resonance and suitably applicable to microwave equipments such as, for example, microwave filters and microwave oscillators.

There has been proposed a ferromagnetic resonator such as, for example, a filter, utilizing the ferromagnetic resonance of a ferrimagnetic yttrium-iron-garnet (hereinafter abbreviated to "YIG") thin film device formed by growing an YIG thin film through a liquid phase epitaxial growth process (hereinafter referred to as "LPE process") on a gadolinium-gallium-garnet (hereinafter abbreviated to "GGG") substrate, and by selectively etching the YIG thin film in a predetermined pattern. Filters of such a kind are disclosed, for example, in U.S. Pat. No. 4,547,754.

The microwave equipment such as a filter employing such an YIG thin film device has advantages in that the Q of resonance in the microwave band is high, the construction is compact, the LPE process and the lithographic selective etching process is suitable for mass-production, and the use of a thin film facilitates forming microwave integrated circuits employing microstrip lines as transmission lines.

As is well known, it has been usual to use YIG single crystal spheres for the ferromagnetic resonator of a microwave equipment utilizing ferromagnetic resonance. The YIG single crystal ball has advantages in that a magnetostatic mode is difficult to establish and the single resonance mode is established in a uniform precession mode. However, the YIG single crystal sphere has problems in processing and mass production. Accordingly, the development and practical application of the ferromagnetic resonator employing a YIG thin film, namely, a ferrimagnetic thin film, has been desired.

Incidentally, the magnetostatic mode established when a DC magnetic field is applied perpendicular to the surface of a ferrimagnetic disk is analyzed in Journal of Applied Physics, Vol. 48, pp. 3001–3007, July, 1977, in which modes are represented by (n, N)m, where n is the number of nodes along the circumferential direction, N is the number of nodes along the diameter, and m-1 is the number of nodes in the direction of thickness. When the high-frequency magnetic field is satisfactorily uniform over the entire range of the ferromagnetic disk, modes of $(1, N)_1$ are principal magnetostatic modes. In constructing a microwave filter or a microwave oscillator, the main mode $(1, 1)_1$ of the $(1, N)_1$ system is employed and the rest of the magnetostatic modes are regarded as spurious modes, namely, spurious response or spurious oscillation. For example, the aforementioned U.S. Pat. No. 4,547,754 proposes a resonator employing a ferrimagnetic YIG thin film provided with an annular groove, and a resonator employing a ferrimagnetic YIG thin film having a central portion of a thickness smaller than that of the peripheral portion thereof, both designed to avoid the spurious response mode.

On the other hand, since the operating frequency of the ferrimagnetic thin film resonator can be varied over a wide range by varying the magnetic field to be applied thereto, the ferrimagnetic thin film resonator is applied, for example, to variable-frequency microwave oscillators and variable-frequency microwave filters. In such application, however, the unloaded Q of the spurious mode increases together with the unloaded Q of the main mode with frequency, and hence the spurious mode cannot be ignored. Such a behavior of the ferrimagnetic thin film resonator is due mainly to the distribution of the exciting magnetization.

As shown in FIG. 23 by way of example, in the exciting method shown in U.S. Pat. No. 4,547,754, a strip line, namely, a transmission line 3, having one end connected to a grounding conductor 2, and having a uniform thickness, a uniform width and a uniform impedance is disposed across a disk-shaped ferrimagnetic thin film 1 so as to be coupled magnetically with the ferrimagnetic thin film 1. Supposing that the direction along the transmission line 3 is an x-direction, the direction along the surface of the ferromagnetic thin film 1 and perpendicular to the x-direction is the y-direction, the distance between the grounded end of the transmission line 3 and the ferrimagnetic thin film 1 is $l_1$, and the length of a portion where the ferromagnetic thin film 1 and the transmission line 3 overlap with each other is $l_2$, a magnetic field Hy generated by a current $i_{rf}$ along the y-direction is substantially uniform when $l_1 \leqq x \leqq l_1 + l_2$.

Calculated distributions of magnetization for modes $(1, N)_1$ (N=1, 2 and 3) over the ferrimagnetic thin film 1 in the state of magnetic resonance are shown in FIG. 24. These distributions of the magnetization are the same with respect to any diametrical direction.

In the consideration of the magnetization distribution of the magnetic field applied to the ferrimagnetic thin film 1 in this construction, when a high-frequency current $i_{rf}$ is supplied, a standing wave Ix is expressed by $$Ix = i_{rf} \cos(2\pi x/\lambda g) \quad (1)$$

where $\lambda_g$ is the wavelength on the transmission line 3. When the y-component of the magnetic field generated by the current $i_{rf}$ is expressed by Hy(x), Hy(x) $\propto$ Ix. That is, $$Hy(x) \propto i_{rf} \cos(2\pi x/\lambda g) \quad (2)$$

Therefore, at a position $x << \lambda_g/4$, namely, a position near the grounded end of the transmission line 3 where x is nearly zero, Hy(x) is practically constant. In a range where $x \leqq \lambda_g/4$, Hy diminishes along a cosine curve to zero at $x = \lambda_g/4$.

Thus, when the frequency of $i_{rf}$ is low, namely, when $\lambda_g$ is comparatively large, Hy is substantially constant along the transmission line 3, and, when the frequency of $i_{rf}$ is comparatively high, namely, when $\lambda_g$ is comparatively small, the grounded end and opposite end of the ferromagnetic thin film 1 are different in the intensity of magnetic field from each other.

OBJECT AND SUMMARY OF THE INVENTION

It is an object of the present invention to provide an improved ferromagnetic resonator.

It is another object of the present invention to provide a ferromagnetic resonator effectively to suppress spurious response.

According to one aspect of the present invention, there is provided a ferromagnetic resonator which comprises a ferrimagnetic thin film, a transmission line coupled to the ferrimagnetic thin film, and a bias magnetic field means applying a bias magnetic field perpendicular to a major surface of the ferrimagnetic thin film: the transmission line generates a magnetic field having distribution similar to magnetization distribution in a main mode of perpendicular ferrimagnetic resonance of the ferrimagnetic thin film.

DESCRIPTION OF THE PREFERRED EMBODIMENTS

A ferromagnetic resonator according to the present invention comprises a ferrimagnetic thin film, and a transmission line coupled with the ferrimagnetic thin film and capable of producing a high-frequency magnetic field distribution corresponding to a magnetization distribution in the main mode of perpendicular magnetic resonance of the ferrimagnetic thin film.

According to the present invention, a magnetic field distribution in the transmission line corresponds to a magnetization distribution in the objective mode of the ferrimagnetic thin film, namely, the main resonance mode of uniform modes. Accordingly, the ferromagnetic thin film and the transmission line are coupled weakly in modes of higher order other than the objective mode, namely, in spurious modes, so that spurious resonance is suppressed.

A ferromagnetic resonator, in a first embodiment, according to the present invention will be described with reference to FIG. 1.

A ferrimagnetic thin film 1 is formed of an YIG thin film in the shape of a disk. A transmission line 3, namely, a strip line, is extended diametrically across the ferrimagnetic thin film 1 and is coupled magnetically with the ferrimagnetic thin film 1. In this embodiment, the transmission line 3 is 50 Ω in impedance and 1.22 mm in width W. Recesses 4 are formed in the transmission line 3 at the opposite ends thereof so as to face the peripheral portions of the ferrimagnetic thin film 1, respectively. Parallel high-impedance portions 5 each having a width Ws of 0.171 mm and high impedance of 100 Ω are formed on the opposite sides of each recess 4.

Figure 1:
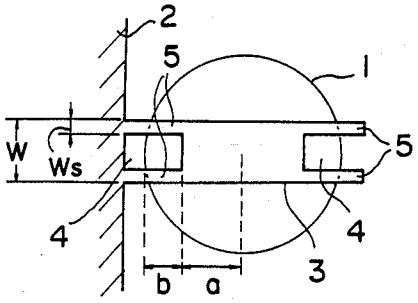
FIG. 1 is a plan view of a ferromagnetic resonator, in a preferred embodiment, according to the present invention, showing the relation between a ferromagnetic thin film and a transmission line.
Figure 2:
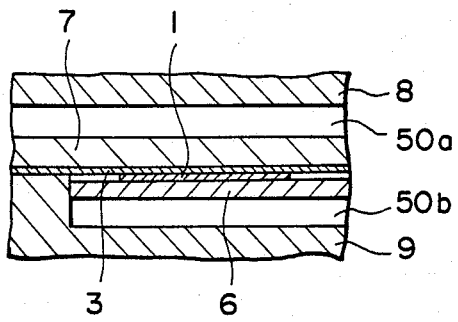
FIG. 2 is a fragmentary sectional view of the essential portion of the ferromagnetic resonator of FIG. 1.

Referring to FIG. 2 showing a resonator incorporating the ferromagnetic thin film 1 in a section, the resonator is formed in a suspended substrate strip line construction which is generally shown in U.S. Pat. No. 4,679,015. The YIG ferrimagnetic thin film 1 is formed by growing YIG in a thin film on a nonmagnetic substrate 6, such as a GGG substrate, and by forming the YIG thin film through a photolithographic process in a predetermined pattern, namely, a disk shape in this embodiment. The transmission line 3 having a necessary pattern as described with reference to FIG. 1 is formed on an insulating substrate 7, such as a Si02 substrate. The transmission line 3 is formed by depositing the insulating substrate 7 with a metal layer through a vacuum evaporation process or a sputtering process, and by etching the metal layer in the predetermined pattern through a photolithographic process.

Then, the GGG nonmagnetic substrate 6 and the insulating substrate 7 are placed one over the other so that the ferrimagnetic thin film 1 and the transmission line 3 are coupled magnetically. The assembly of the GGG nonmagnetic substrate 6 and the insulating substrate 7 is held between an upper conductor 8 and a lower conductor 9 with air gaps 50*a* and 50*b* between the transmission line 3 and the upper conductor 8 and between the nonmagnetic substrate 6 and the lower conductor 9, respectively. As described with reference to FIG. 1, the transmission line 3 is connected electrically at one end thereof to the lower conductor 9 serving also as a grounding electric conductor 2.

In the ferromagnetic resonator of the present invention thus constructed, the transmission line 3 includes a 50 Ω-line and parallel 100 Ω-lines. Therefore, undesired reflection due to impedance mismatching is prevented, and a high-frequency current transmitted through the 50 Ω-line is distributed substantially equally to the two parallel 100 Ω-lines, so that the intensity of the magnetic field produced by the 100 Ω-line is reduced to approximately a half of that produced by the 50 Ω-line.

Figure 5:
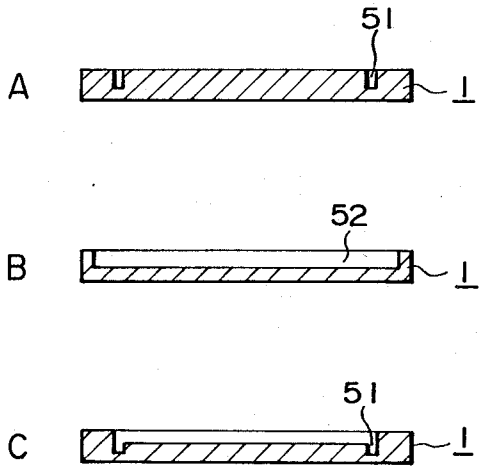
FIGS. 5A, 5B and 5C are sectional views of ferromagnetic thin films according to the present invention, respectively.
Figure 3:
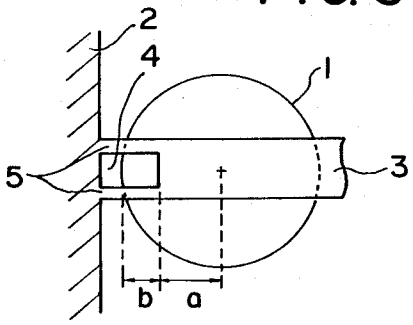
FIGS. 3 and 4 are plan views showing the relation between a ferrimagnetic thin film and a transmission line in further embodiments of the present invention, respectively.
Figure 4:
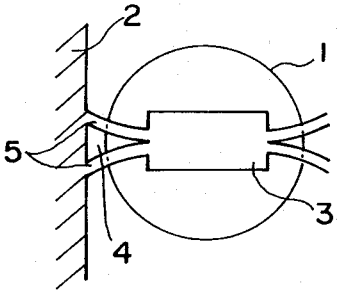

In the first embodiment shown in FIG. 1, the recess 4 are formed in the transmission line 3 so as to face the diametrically opposite peripheral portions of the ferrimagnetic thin film 1. However, only one recess 4 may be formed in the grounded end of the transmission line 3 as illustrated in FIG. 3 or, as illustrated in FIG. 4, a pair of high-impedance lines 5, for example, 100 Ω-lines, curving away from each other may be formed at each end of the transmission line 3 to incline the magnetic field Hy along the 100 Ω-lines so that the magnetic field distribution approaches the magnetization distribution in the main mode. In FIGS. 3 and 4, parts corresponding to those previously described with reference to FIG. 1 are denoted by like reference numerals and the description thereof will be omitted The ferrimagnetic thin film 1 may be formed with the construction as disclosed in U.S. Pat. No. 4,547,754 to enable the ferrimagnetic thin film 1 per se to suppress the spurious magnetostatic mode liable to be generated therein. That is, the generation of magnetization distribution in the spurious resonance mode is suppressed and scarcely effects the main resonance mode by utilizing the fact that the magnetization distribution in the magnetostatic mode in the ferrimagnetic thin film 1 is different between the main resonance mode and the spurious resonance mode. As shown in FIG. 5A by way of example, an annular groove 51 is formed concentrically in the ferrimagnetic thin film 1 so that the high-frequency magnetization of a mode $(1, 1)_1$ is zero. The annular groove 51 may be either a continuous groove or an intermittent groove.

Another construction of the ferrimagnetic thin film 1 may be formed in which a thin portion 52 is formed in the inner area of the ferrimagnetic thin film 1 as shown in FIG. 5B to suppress excitation of the spurious mode by expanding the flat demagnetizing field in the inner area of the ferrimagnetic thin film 1.

Furthermore, as shown in FIG. 5C, the ferrimagnetic thin film may be provided with a groove 51 and a thin area 52 limited by the groove 51.

Still further, in addition to forming the groove 51 and/or the thin portion 52, or with neither the groove 51 nor the thin portion 52, a necessary magnetization distribution may be obtained through nonmagnetic ion implantation, to suppress the magnetization of the higher mode.

Figure 6:
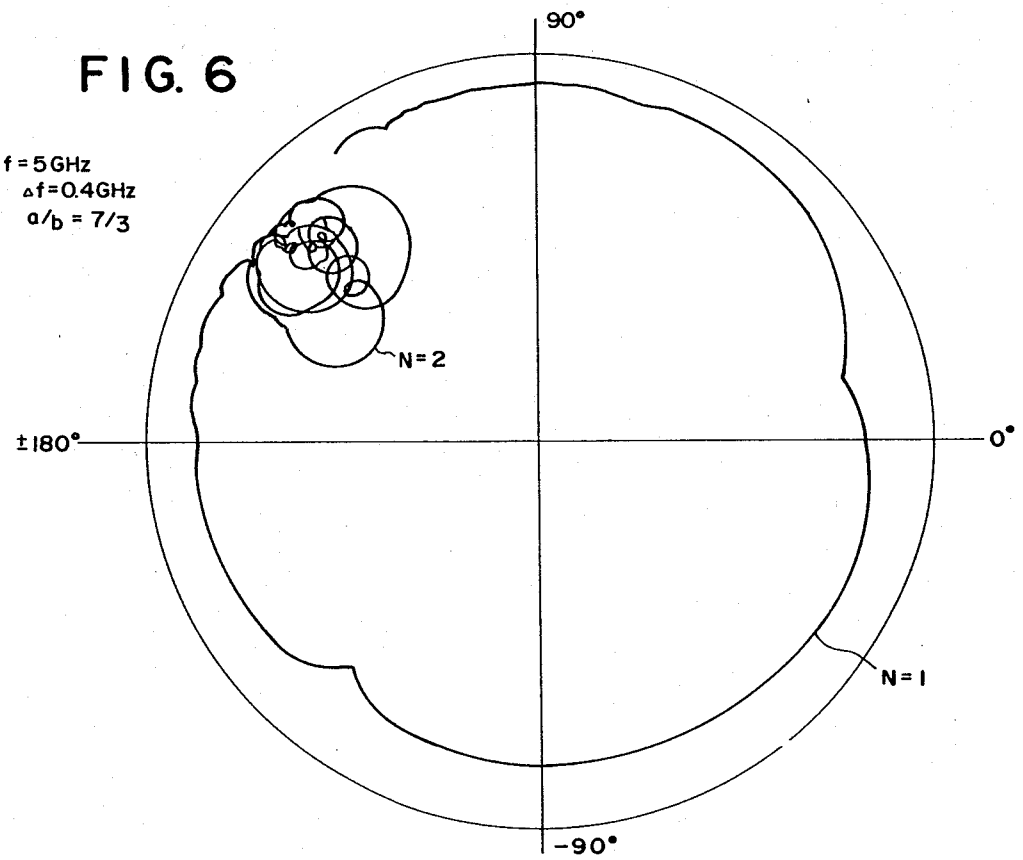
FIGS. 6, 7 and 8 are diagrams showing the reflection characteristics of ferromagnetic resonators according to the present invention, respectively.
Figure 7:
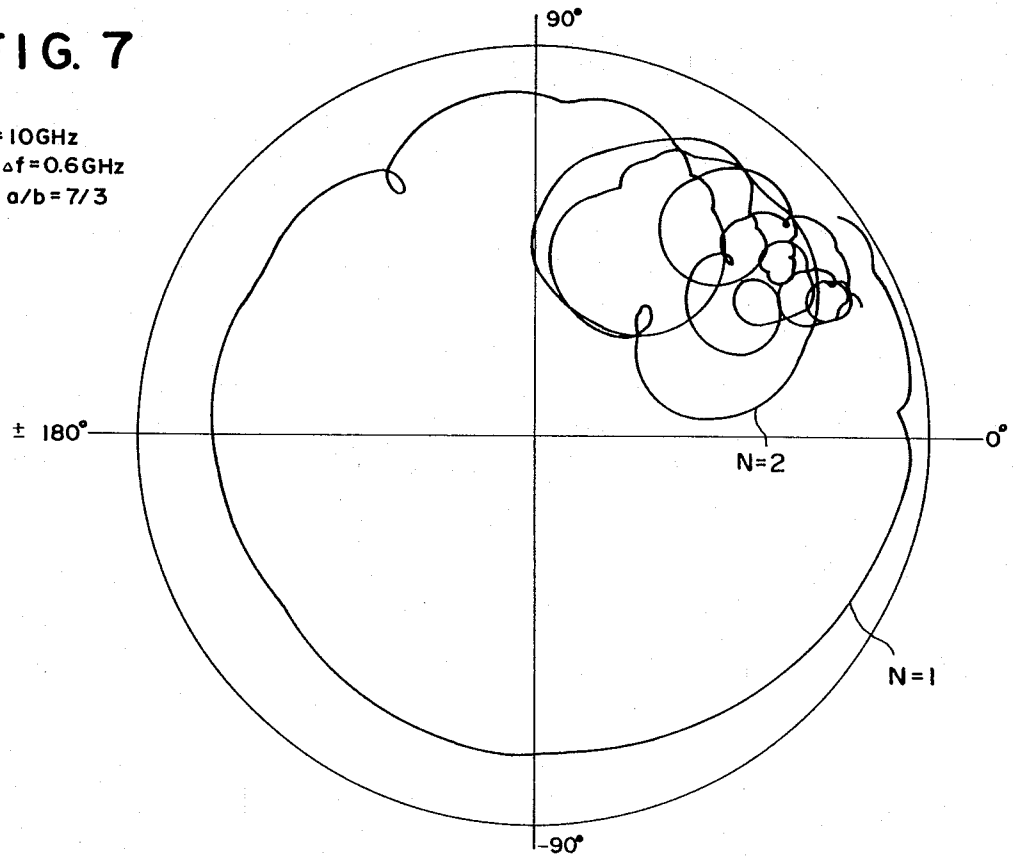
Figure 8:
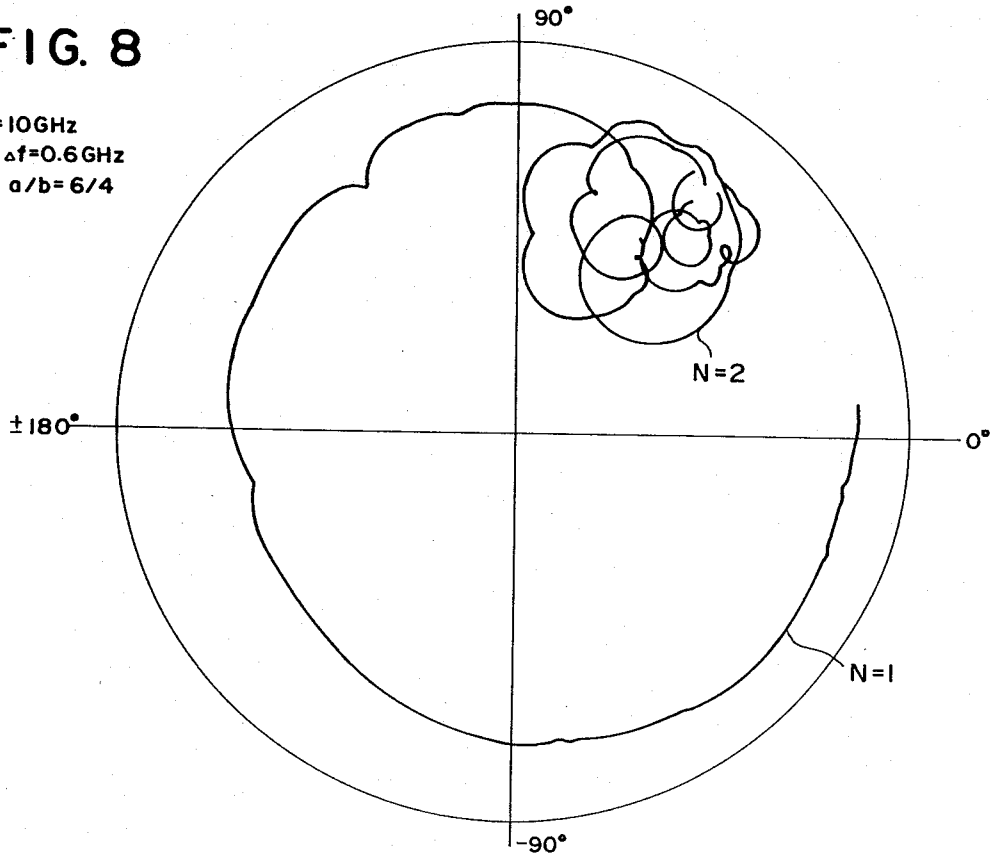
Figure 23:
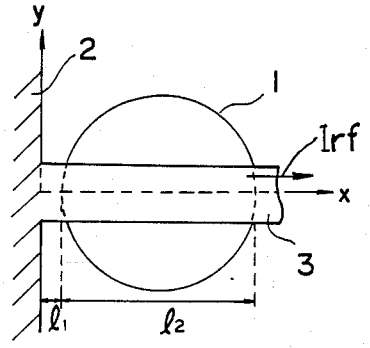
FIG. 23 (PRIOR ART)
FIG. 23 is a plan view of a prior art ferromagnetic resonator.
Figure 24:
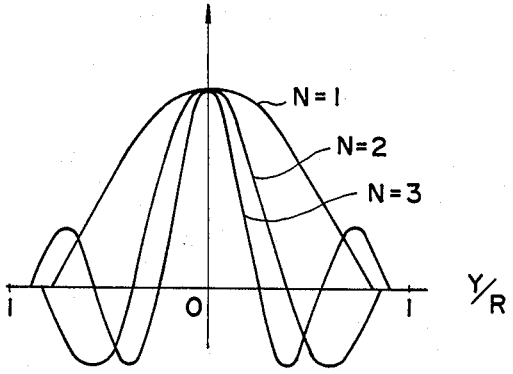
FIG. 24 is a diagram showing a magnetization distribution of assistance in explaining the conventional exciting method.
Figure 25:
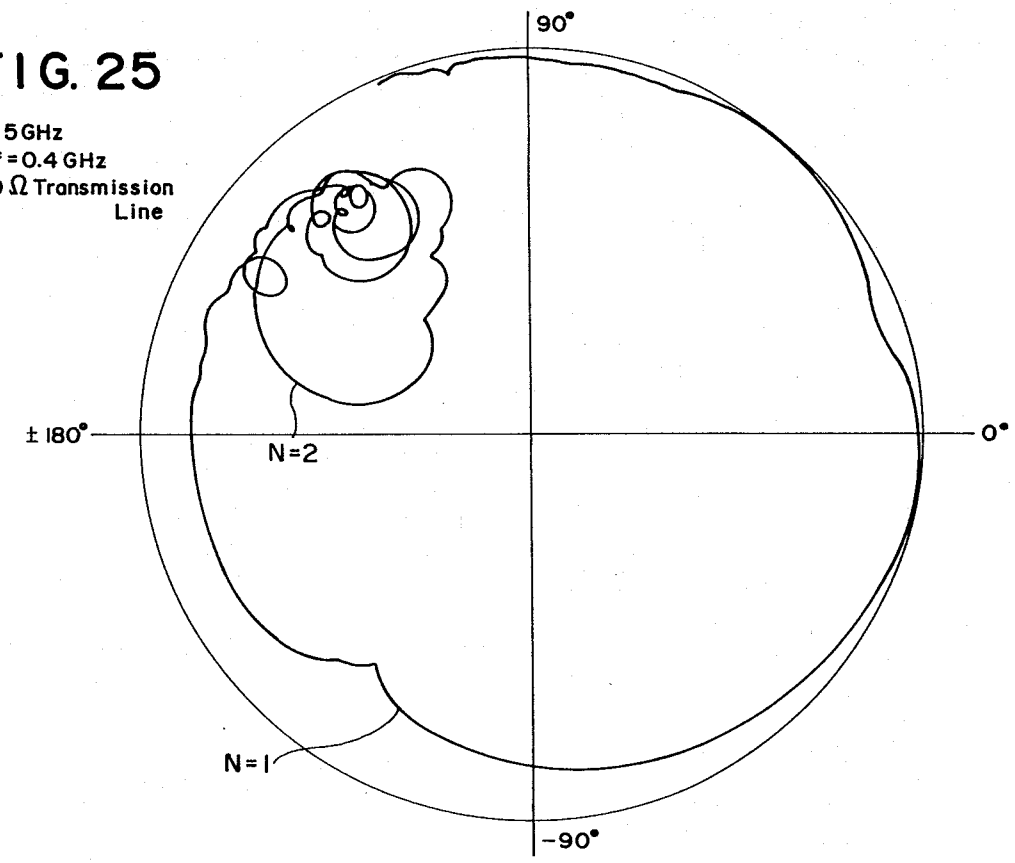
FIGS. 25 and 26 are diagrams showing the reflection characteristics of a conventional ferromagnetic resonator.
Figure 26:
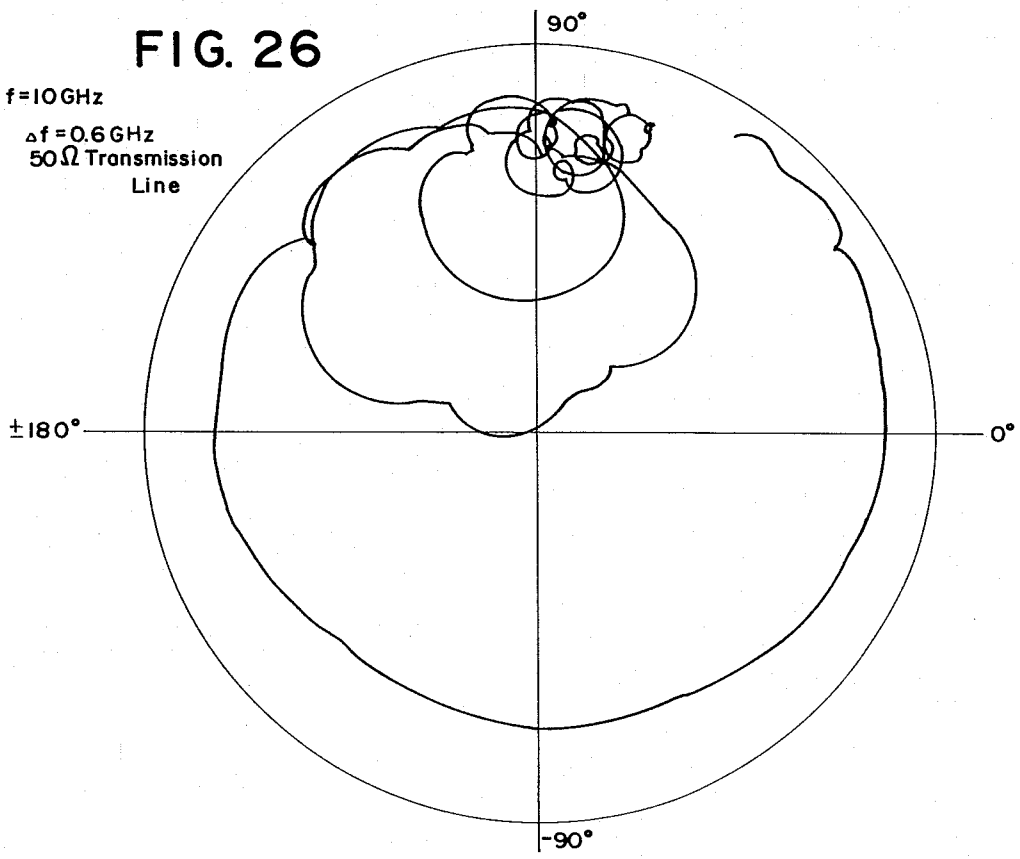

FIGS. 6 to 8 are Smith charts showing measured reflection characteristics of ferromagnetic resonators of a construction shown in FIG. 1 (FIGS. 6 and 7) and of a construction shown in FIG. 3 (FIG. 8) each employing a ferromagnetic thin film 1 of FIG. 5A having the groove 51. FIGS. 6, 7 and 8 show the measured reflection characteristics when resonance frequency f=5 GHz and span Δf=0.46 GHz, when f=10 GHz and Δf=0.6 GHz, and when f=10 GHz and Δf=0.6 GHz, respectively. FIGS. 25 and 26 are also Smith charts showing the measured reflection characteristics of the ferromagnetic resonator described with reference to FIG. 23 when f=5 GHz and Δf=0.4 GHz, and when f=10 GHz and Δf=0.6 GHz, respectively. In the ferromagnetic resonator having the reflection characteristics shown in FIGS. 6 and 7, namely, the ferromagnetic resonator of the construction shown in FIG. 1, and in the ferromagnetic resonator having the reflection characteristics shown in FIG. 8, namely, the ferromagnetic resonator of the construction shown in FIG. 3, a/b=7/3, and a/b=6/4, respectively, where a is the distance between the center of the ferromagnetic thin film 1 and the inner edge of the recess 4, and b is the distance between the inner edge of the recess 4 and the periphery of the ferrimagnetic thin film 1.

As obvious from the comparison between the reflection characteristics of the ferromagnetic resonators of the present invention shown in FIGS. 6 to 8 and those of the ferromagnetic resonator shown in FIGS. 25 and 26 without applying the present invention, the ferromagnetic resonators of the present invention effectively suppress spurious modes where N is two or greater.

Figure 9:
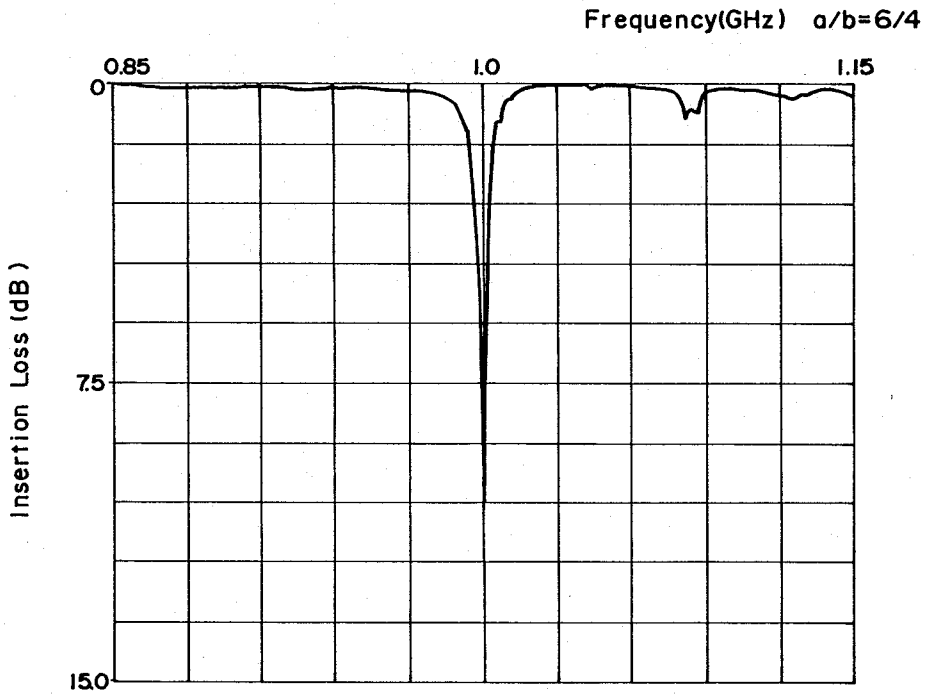
FIGS. 9 and 10 are diagrams showing measured insertion losses of ferromagnetic resonators according to the present invention, respectively.
Figure 10:
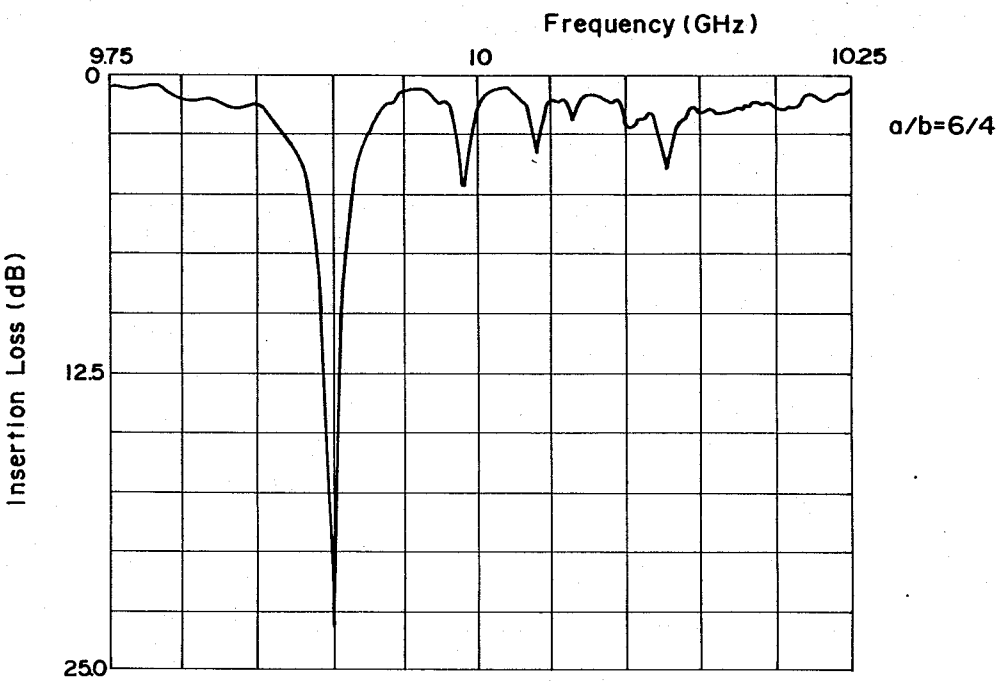
Figure 27:
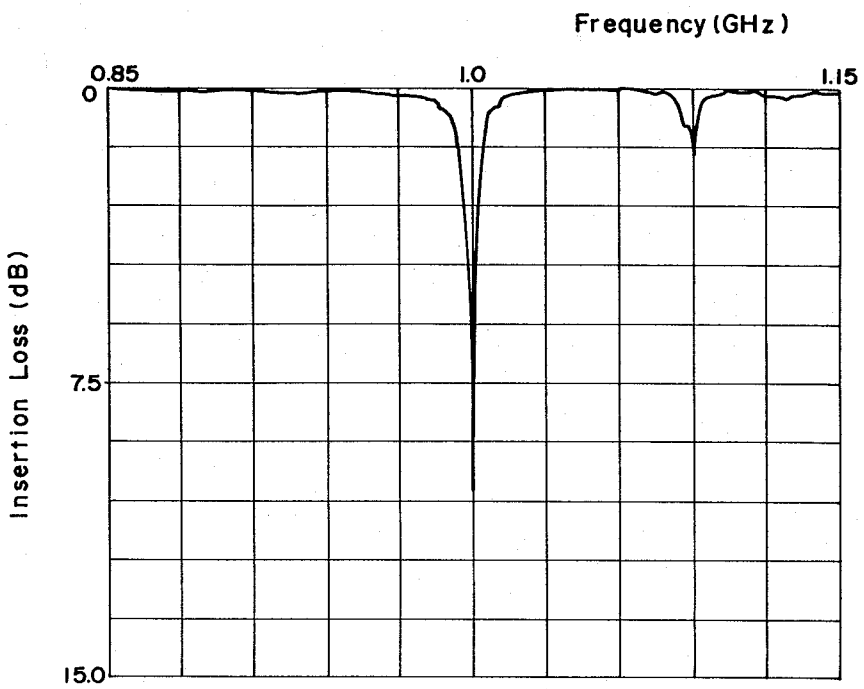
FIGS. 27 and 28 are diagrams showing measured insertion losses of a conventional ferromagnetic resonator.
Figure 28:
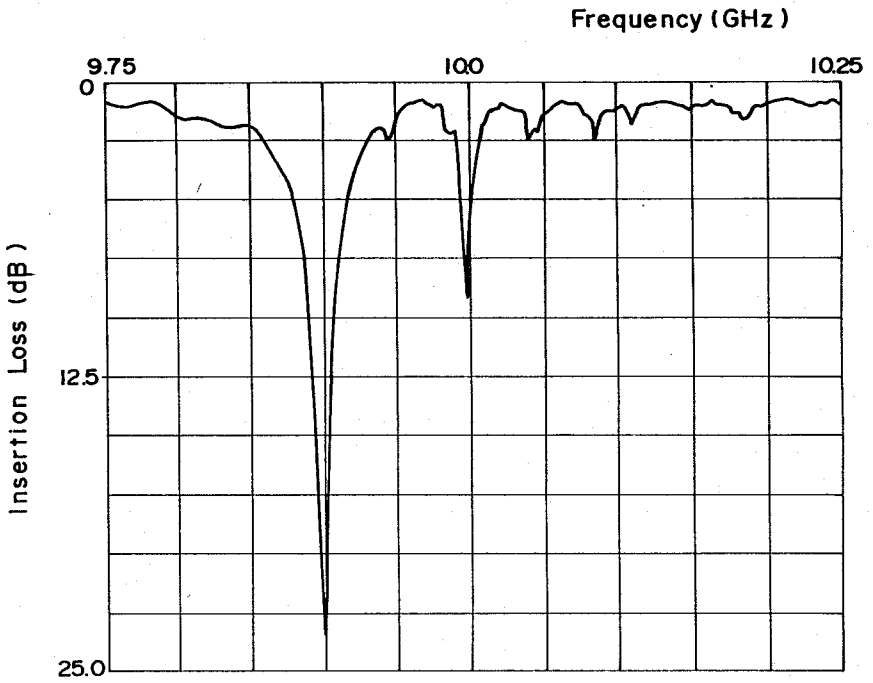

FIGS. 9 and 10 show measured transmission characteristics, namely, the variation of insertion loss with frequency, of the ferromagnetic resonator of the present invention shown in FIG. 1. FIGS. 27 and 28 show measured transmission characteristics of the ferromagnetic resonator shown in FIG. 23. In measuring the transmission characteristics, the strip lines each was connected at one end thereof to a signal source and at the other end to a matching load.

As apparent from the comparison of FIGS. 9 and 10 and FIGS. 27 and 28, the ferromagnetic resonator of the present invention is capable of effectively suppressing the spurious mode. The respective external Qs (Qes) of the ferromagnetic resonator (FIG. 23) and the ferromagnetic resonator of the present invention having 100 Ω-lines (FIG. 1) in the second-order spurious mode are 433 and 474 for 1 GHz and 10 GHz, respectively, and 718 and 918 for 1 GHz and 10 GHz, respectively.

Figure 11:
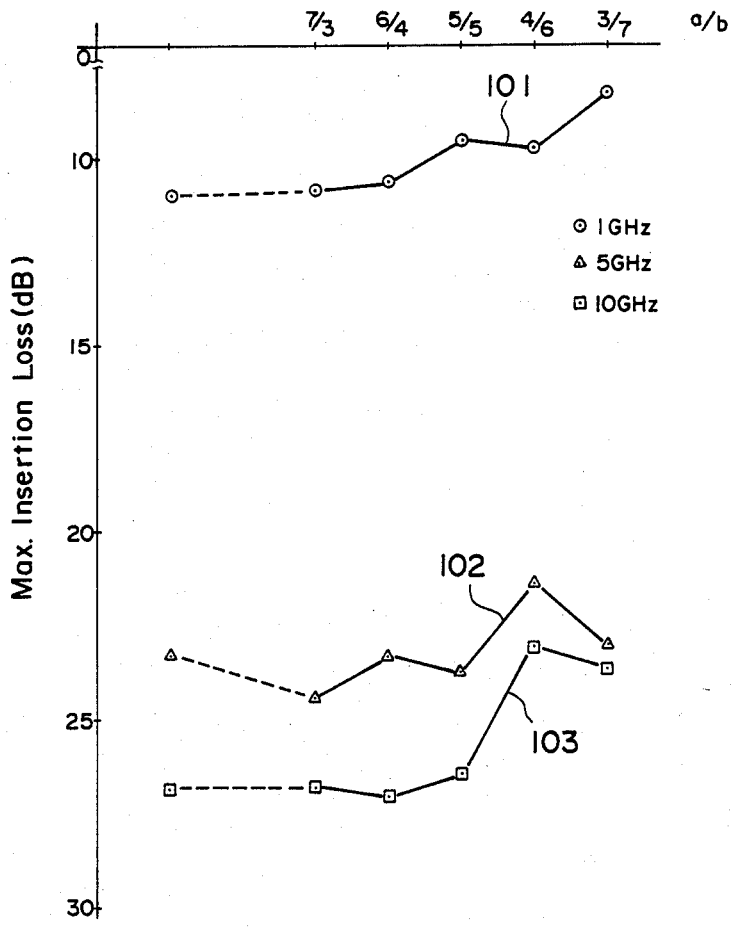
FIGS. 11 and 12 are graphs showing the measured dependence of insertion loss in the transmission line on the ratio a/b of the transmission line for frequencies in the main mode and in the spurious mode, respectively.

FIG. 11 shows the measured variation of the maximum insertion loss in the main mode with a/b representing the length of the 100 Ω-lines, namely, high-impedance portions 5, for the ferromagnetic resonator of FIG. 1. In FIG. 11, curves 101, 102 and 103 are for center frequencies of 1 GHz, 5 GHz and 10 GHz, respectively.

Figure 12:
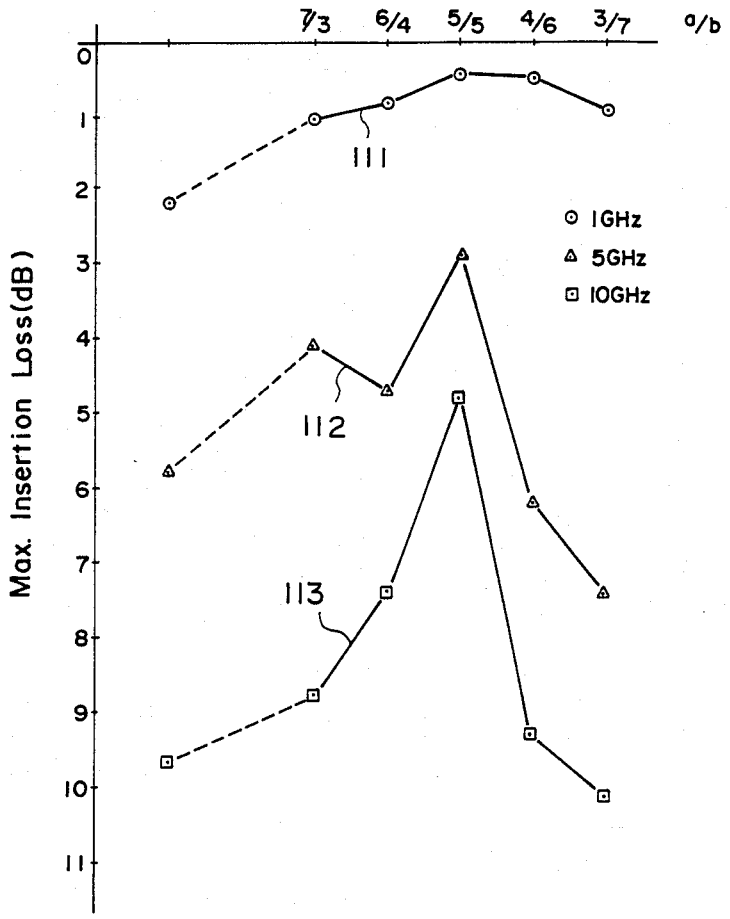

FIG. 12, similarly to FIG. 11, shows the measured variation of the maximum insertion loss in the spurious mode with a/b for the same ferromagnetic resonator. In FIG. 12, curves 111, 112 and 113 are for center frequencies of 1 GHz, 5 GHz and 10 GHz, respectively. As apparent from FIG. 12, the insertion loss in the spurious mode is smallest, namely, the transmission characteristics are improved, when the ratio a/b is on the order of 5/5.

Figure 13:
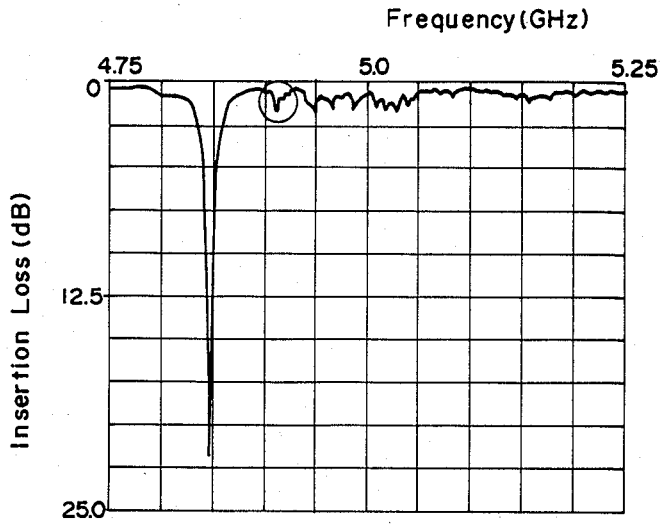
FIGS. 13 and 14 are diagrams showing measured insertion losses in the transmission lines of ferromagnetic resonators according to the present invention, respectively.
Figure 14:
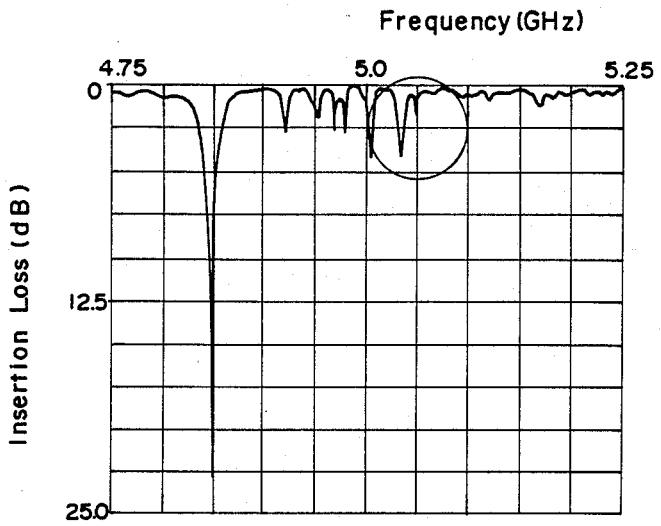
Figure 15:
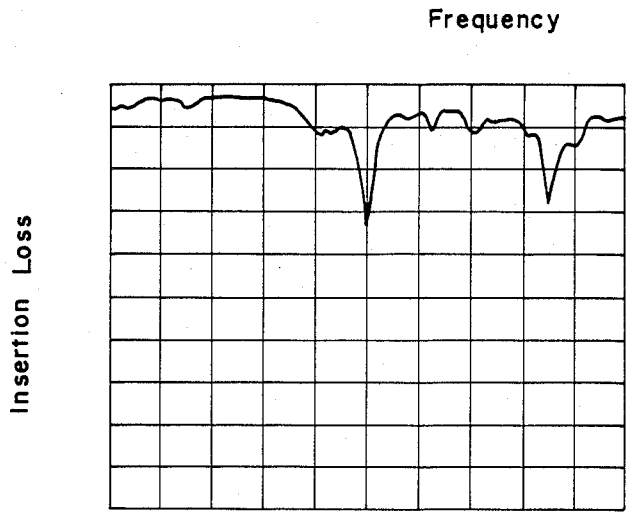
FIGS. 15 and 16 are enlarged views of encircled portions in FIGS. 13 and 14, respectively.
Figure 16:
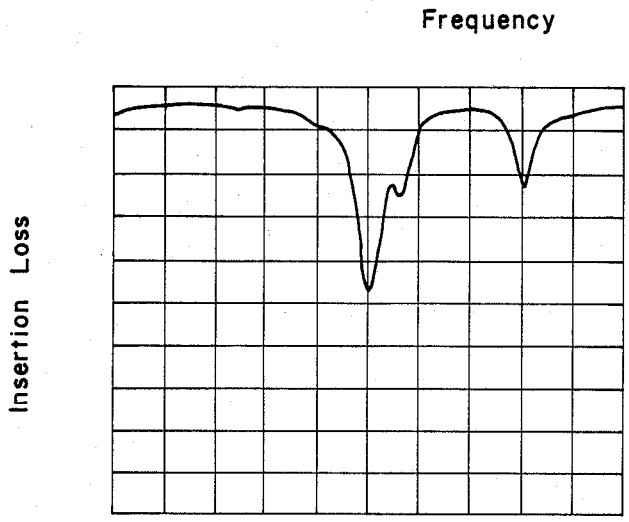
Figure 29:
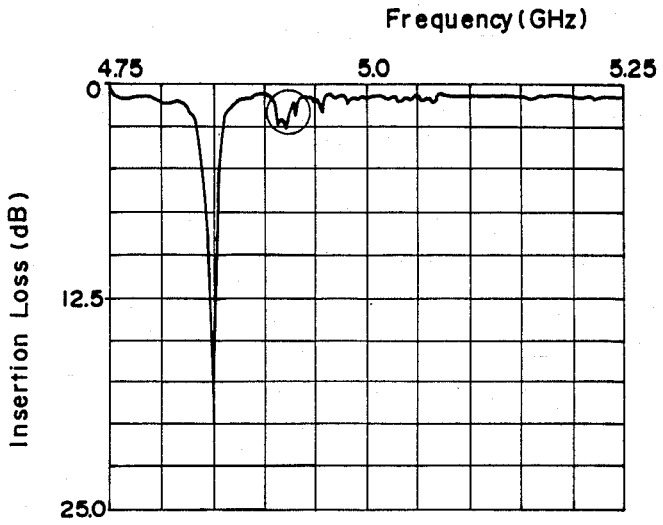
FIGS. 29 and 30 are diagrams showing measured insertion losses of a conventional ferromagnetic resonator.
Figure 30:
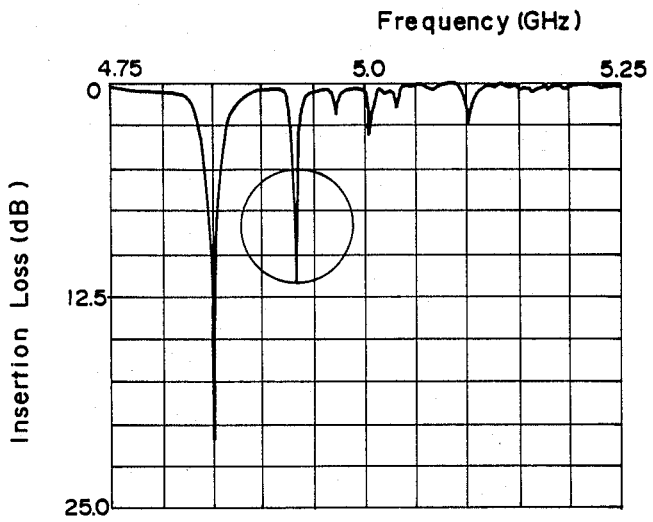
Figure 31:
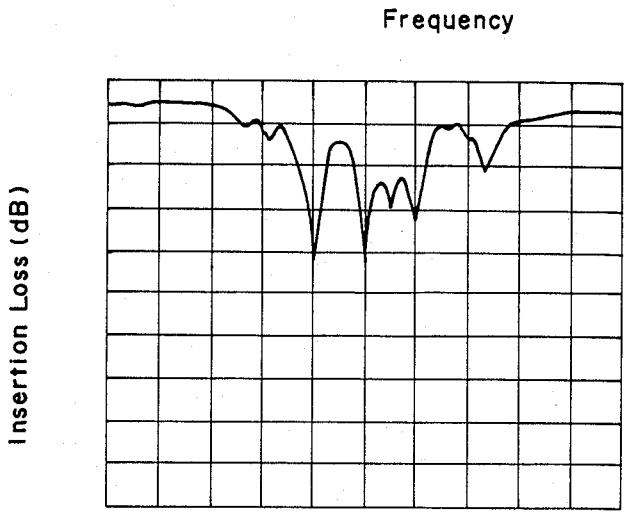
FIGS. 31 and 32 are enlarged views of encircled portions in FIGS. 29 and 30, respectively.
Figure 32:
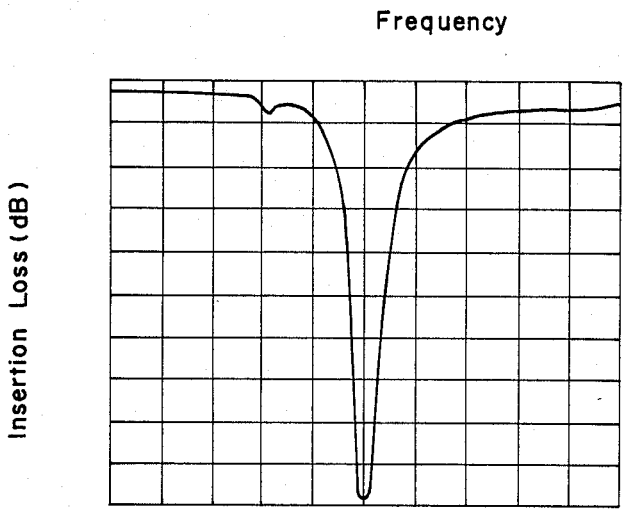

FIGS. 13 and 14 show the variation of insertion loss with frequency for the ferromagnetic resonator of FIG. 1 employing an YIG ferrimagnetic thin film 1 having an annular groove, and for the same ferromagnetic resonator employing an YIG ferrimagnetic thin film 1 without the annular groove, respectively, wherein a/b is pb 5/5. FIGS. 15 and 16 are enlarged illustrations of encircled portions in FIGS. 13 and 14, respectively, showing the insertion loss in the spurious mode. FIGS. 29 and 30 show the variation of insertion loss with frequency in a frequency band having a center frequency on the order of 5 GHz for the ferromagnetic resonator of FIG. 23 employing an YIG ferrimagnetic thin film 1 having an annular groove, and for the ferromagnetic resonator of FIG. 23 employing an YIG ferromagnetic thin film 1 without the annular groove, respectively. FIGS. 31 and 32 are enlarged illustrations of encircled portions in FIGS. 29 and 30, respectively, in the spurious mode.

As is evident from the comparative observation of FIGS. 15, 16, 31 and 32, the ferromagnetic resonator of the present invention is capable of effectively reducing insertion loss in the spurious mode and, as is evident from FIG. 15, the ferrimagnetic thin film provided with the annular groove 51 further improves insertion loss in the spurious mode.

In the foregoing embodiments of the present invention, the pattern of the transmission line 3 is selected form a suitable magnetic field distribution on the YIG ferromagnetic thin film 1. It is also possible to form the suitable magnetic field distribution on the ferrimagnetic thin film 1 by bending the surface of the transmission line 3 as illustrated in FIG. 17 to couple the transmission line 3 with the ferrimagnetic thin film 1 in a desired distribution of the degree of coupling.

Figure 17:
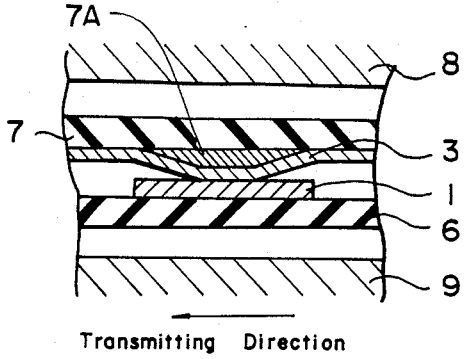
FIGS. 17, 18 and 19 are fragmentary sectional views of the essential portions of ferromagnetic resonators, in further embodiments, according to the present invention, respectively.

In an embodiment shown in FIG. 17, a transmission line 3 is extended along a spacer 7A provided on an insulating substrate 7.

Figure 18:
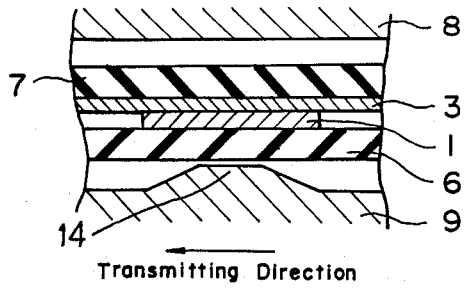
Figure 19:
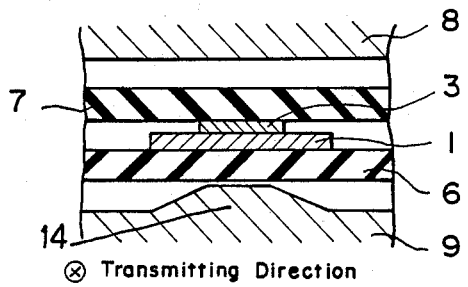

FIGS. 18 and 19 show a ferromagnetic resonator, in another embodiment, according to the present invention. FIG. 18 is a longitudinal sectional view, namely, a sectional view taken along the direction of transmission, and FIG. 19 is a cross-sectional view, namely, a sectional view taken across the direction of transmission. In this embodiment, a protrusion 14 is formed, for example, in the surface of a lower electric conductor 9 facing an YIG ferrimagnetic thin film 1 so that the distance between the lower electric conductor 9 and the ferrimagnetic thin film 1 vary in a desired distribution over the ferrimagnetic thin film 1 to selectively form a desired magnetic distribution on the ferrimagnetic thin film 1. In FIGS. 17, 18 and 19, parts similar to those previously described with reference to FIG. 1 are denoted by the same reference numeral and the description thereof is omitted.

Figure 20:
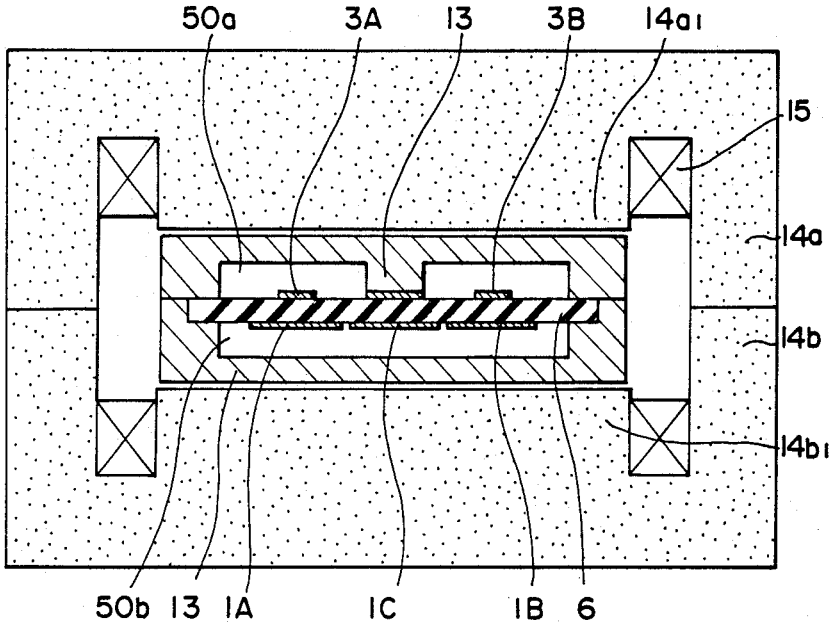
FIGS. 20, 21 and 22 are a sectional view, a plan view of the essential portion, and an exploded perspective view, respectively, of a variable-frequency microwave filter incorporating the present invention.
Figure 21:
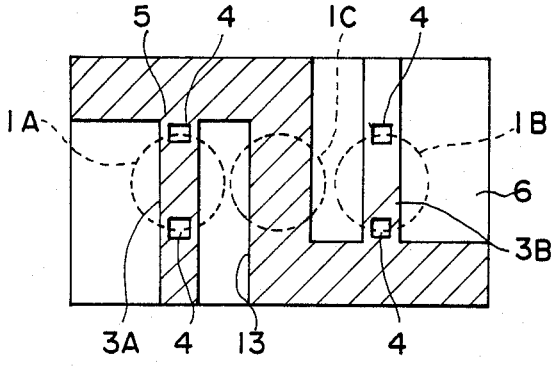
Figure 22:
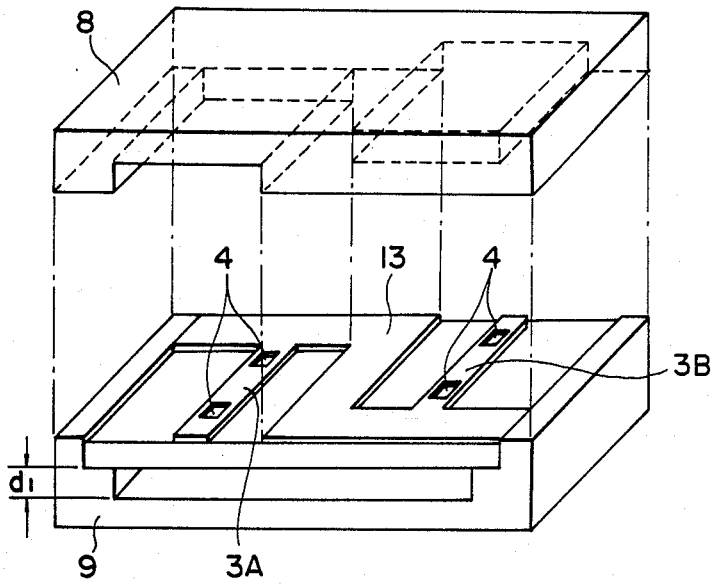

FIGS. 20 to 22 illustrates a ferromagnetic resonator according to the present invention as applied to a variable-frequency microwave filter, in which FIGS. 20, 21 and 22 are a sectional view, a plan view and an exploded perspective view, respectively, of the variable-frequency microwave filter.

Referring to FIGS. 20 to 22, a first YIG ferrimagnetic thin film 1A and a second YIG ferromagnetic thin film 1B are formed over a GGG nonmagnetic substrate 6 with a predetermined space therebetween. A third YIG ferromagnetic thin film 1C is formed over the GGG nonmagnetic substrate 6 between the first and second YIG ferromagnetic thin films 1A and 1B to magnetically couple the first and second YIG ferrimagnetic thin films 1A and 1B. A first transmission line 3A, namely, an input microstrip line, and a second transmission line 3B, namely, an output microstrip line, are formed on the other side of the GGG nonmagnetic substrate 6 so as to be coupled with the first and second YIG ferrimagnetic thin films 1A and 1B, respectively. A central grounding pattern 13 is formed on the surface carrying the input transmission line 3A and the output transmission line 3B of the GGG nonmagnetic substrate 6 across an area extending opposite to the third YIG ferromagnetic thin film 1C so as to interconnect one end of the first transmission line 3A and one end of the second transmission line 3B opposite the end of the first transmission line 3A connected to the grounding pattern 13. The nonmagnetic substrate 6 carrying the ferrimagnetic thin films 1A, 1B and 1C, the transmission lines 3A and 3B, and the grounding pattern 13 is held between an upper electric conductor 8 and a lower electric conductor 9 with the grounding pattern 13 and the respective grounded ends of the transmission lines 3A and 3B in electrical contact with the upper electric conductor 8. The nonmagnetic substrate 6 carrying the ferrimagnetic thin films 1A, 1B and 1C, the transmission lines 3A and 3B and the grounding pattern 13, the upper electric conductor 8 and the lower electric conductor thus assembled form a microwave filter unit. The microwave filter unit is disposed in the magnetic gap formed between the respective magnetic poles $14a_1$ and $14b_1$ of a pair of bell-shaped magnetic cores 14*a* and 14*b*. At least either the magnetic core 14*a* or 14*b* is provided with a coil 15 on the central magnetic pole thereof. DC current supplied to the coil 15 is regulated to vary the center frequency of resonance for variable-frequency control.

The microwave filter unit may be formed in any one of the constructions shown in FIGS. 1, 3, 4, 17, 18 and 19 to provide desired magnetic field distributions on the input ferrimagnetic thin film 1A and the output ferrimagnetic thin film 1B to make the ferrimagnetic thin films 1A and 1B suppress the spurious mode.

As described hereinbefore, according to the present invention, a magnetic field distribution corresponding to the magnetization distribution in the main mode is formed on the ferrimagnetic thin film 1 serving as a resonance element to reduce the degree of coupling of the ferrimagnetic thin film 1 with the transmission line 3 in the spurious mode, so that the spurious resonance can effectively be suppressed. Furthermore, the present invention suppressed the spurious resonance through simple structural modification and disposition of the transmission line without requiring any additional element.

We claim as our invention:

1. A ferromagnetic resonator comprising:

a ferrimagnetic thin film, a transmission line coupled to a major surface of said ferrimagnetic thin film, and a bias magnetic field means applying a bias magnetic field perpendicular to said major surface of said ferrimagnetic thin film, said transmission line being formed of a microstrip line having a first portion coupled to a central portion of said ferrimagnetic thin film and a second portion coupled to a peripheral portion of said ferrimagnetic thin film, said second portion being formed of a plurality of parallel strip line portions each being higher in impedance than said first portion.

2. A ferromagnetic resonator according to claim 1, said ferrimagnetic thin film is formed in a disk shape.

3. Apparatus according to claim 2, wherein said second portion overlies the periphery of said disk.

4. A ferrimagnetic resonator according to claim 1, said ferrimagnetic thin film disk having said peripheral portion processed to suppress magnetization of magnetostatic mode other than $(1, 1)_1$ mode.

5. A ferrimagnetic resonator according to claim 4, including an annular groove in said peripheral portion.

6. Apparatus according to claim 1, wherein said second portion includes two parts, each part overlying a diametrically opposite peripheral portion of said thin film, and means for connecting one of said two parts to a reference potential.

7. Apparatus according to claim 1, wherein said first portion has a first impedance and second portion comprises a pair of parallel microstrip lines each having an impedance equal to twice that of said first portion.

8. Apparatus according to claim 7, wherein said first portion of said microstrip line has a first width, and wherein the lines of said pair of lines are spaced apart so that their edges most remote from each other are spaced apart by approximately said first width.

9. Apparatus according to claim 1, wherein said first and second portions have respective lengths which are approximately equal to each other.

10. A ferromagnetic resonator comprising:

a ferrimagnetic thin film;

a transmission line coupled to a major surface of said ferrimagnetic thin film formed of a microstrip line, a bias magnetic field means applying a bias magnetic field perpendicular to said major surface of said ferrimagnetic thin film, and a conductor wall provided on the opposite side of said microstrip line relative to said ferrimagnetic thin film, said microstrip line and said conductor wall being spaced apart by first distance at a central portion of said thin film, said microstrip line and said conductor wall being spaced apart at a peripheral portion of said thin film by a second distance greater than said first distance.

11. A ferromagnetic resonator comprising:

a ferrimagnetic thin film, a transmission line coupled to a major surface of said ferrimagnetic thin film, and a bias magnetic field means applying a bias magnetic field perpendicular to said major surface of said ferrimagnetic thin film, said transmission line being formed of a microstrip line coupled to a central portion of said thin film, said microstrip line having a first portion overlying the central portion of said thin film and spaced therefrom by a first distance, and at least one second portion overlying a peripheral portion of said thin film spaced therefrom by a second distance greater than said first distance.

12. Apparatus according to claim 11, wherein said first portion has a first impedance and said second portion comprises a pair of microstrip lines arranged side-by-side, each of said pair of microstrip lines having an impedance equal to twice that of said first portion, said pair of microstrip lines being connected at adjacent locations to said first portion, and said pair of microstrip lines diverging from each other in the direction away from said first portion.

* * * * *